United States Patent [19]

Ueno et al.

[11] 4,146,435

[45] Mar. 27, 1979

[54] DUST COLLECTING SYSTEM FOR COKE OVEN

[75] Inventors: Hajime Ueno; Kentaro Kakumura, both of Nishinomiya; Nobukastu Sasaki, Amagasaki; Yorito Sato, Nishinomiya, all of Japan

[73] Assignees: Mitsubishi Chemical Industries, Ltd., Ayogo; Kansai Netsukagaku Kabushiki Kaisha, Tokyo, both of Japan

[21] Appl. No.: 788,349

[22] Filed: Apr. 18, 1977

Related U.S. Application Data

[63] Continuation of Ser. No. 644,922, Dec. 29, 1975, abandoned.

[30] Foreign Application Priority Data

Dec. 28, 1974 [JP] Japan ..... 49-149244

[51] Int. Cl.[2] ..... C10B 57/00; C10B 35/00

[52] U.S. Cl. ..... 201/27; 201/26; 201/41; 202/262; 202/263; 55/341 R

[58] Field of Search ..... 201/2, 26, 27, 41; 202/262, 263; 55/302, 341 R, 385 R, 385 D, 83, 97; 266/15, 16, 157, 158

[56] References Cited

U.S. PATENT DOCUMENTS

| | | | |
|---|---|---|---|
| 3,767,536 | 10/1973 | Ikeda et al. | 202/263 |
| 3,897,313 | 7/1975 | Ibaragi et al. | 202/263 |
| 3,972,780 | 8/1976 | Calderon | 202/263 |

FOREIGN PATENT DOCUMENTS

| | | | |
|---|---|---|---|
| 1310980 | 3/1973 | United Kingdom | 202/263 |

OTHER PUBLICATIONS

Pangborn Bulletin No. 922B received 5/11/72.

The Mikro-Pulsaire Dust Collector: Bulletin PC-1, received 4/25/66.

*Primary Examiner*—Morris O. Wolk

*Assistant Examiner*—Michael S. Marcus

*Attorney, Agent, or Firm*—Oblon, Fisher, Spivak, McClelland & Maier

[57] ABSTRACT

An improved dust collecting system for a coke oven employs a bag filter dust collector as a common dust collector for both the coke discharge operation and the coal charging operation. First, the dust spouted out in the coke discharge operation and then successively and alternatingly, the dust spouted out in the coal charging operation and in the coke discharge operation are collected, whereby fine coal particles deposited out in the coal charging step are deposited on the layer of the fine coke particles firstly deposited out in the coke discharging operation. In addition, a combustion chamber is provided for burning the gases and dusts spouted off in the coal charging operation and a pre-dust wet-type collector is utilized therein for preliminary filtering before the same is fed to the common bag filter dust collector.

2 Claims, 5 Drawing Figures

FIG. 1
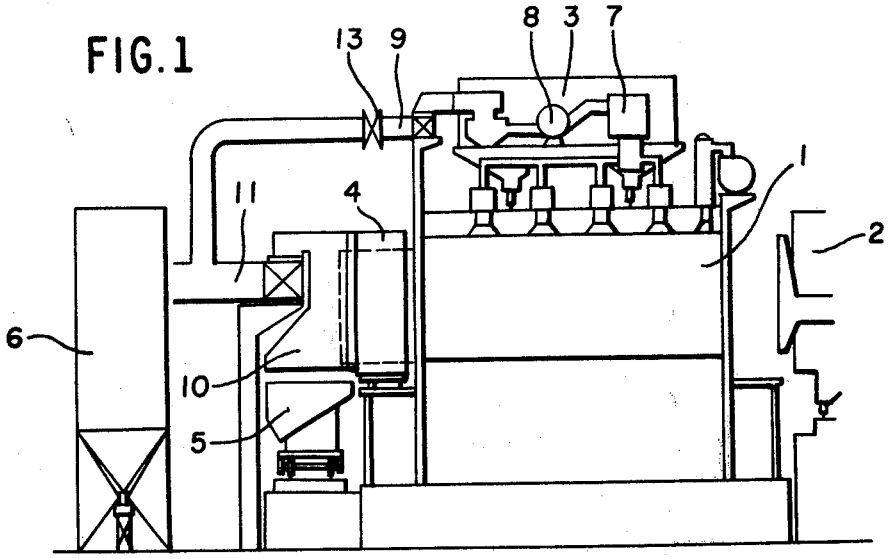
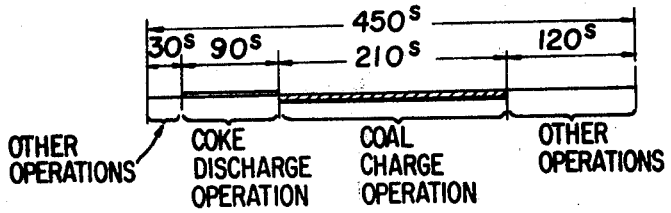
FIG. 4
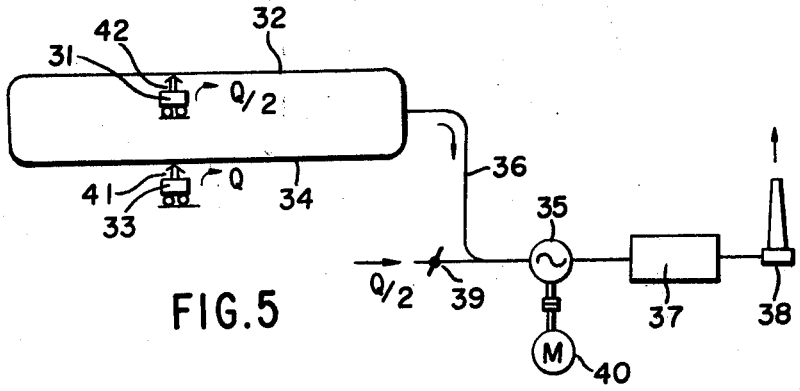
FIG. 5

DUST COLLECTING SYSTEM FOR COKE OVEN

This is a continuation, of application Ser. No. 644,922, filed Dec. 29, 1975 now abandoned.

BACKGROUND OF THE INVENTION

1. Field of the Invention

The present invention relates generally to the operation of coke ovens and more particularly to an improved dust collecting system for a coke oven.

2. Description of the Prior Art

In the operation of coke ovens, a severe problem of dust being thrown off has been caused at the step of discharging coke from a coke oven, hereinafter being referred to as the coke discharge step, and at the step of charging coal for carbonization, hereinafter being referred to as the coal charge step.

In order heretofore to collect such gases and dust given off from a fire extinguishing, or quenching, car and a coke guide car at the coke discharge step, a system of drawing or sucking dust and gases through a fixed duct to a dust collector, or settling chamber, disposed on the ground has been employed which features covering the coke guide car with a hood. This system is effective and has been relatively satisfactory.

However, the gas spouted out from the carbonizing, or oven, chamber at the coal charge step contains dust and a large content of combustible gases and tar mists. Accordingly, though various dust collecting systems have been proposed, a desirable system which is fully satisfactory from the viewpoints of stability, economy and efficiency of dust collection has yet to be attained. For example, it has been proposed to employ a system wherein a combustion chamber and a gas sucking device are equipped on the coal feed car so as to provide for suction and combustion of gas spouted from the oven chamber and to feed the exhaust gas through a fixed duct to a dust collector disposed on the ground. It has been also proposed to employ such a system having a combustion chamber disposed on the ground.

The dust containing gases which spout out at the coal charge step have low calorie value and are of large volume. In order to attain a complete combustion, it is necessary to increase the temperature in the combustion chamber to higher than 700° C. Accordingly, a large amount of auxiliary fuel is required, thus making for an uneconomical operation.

In the conventional combustion system, only the ignition source is fed into the combustion chamber, so as to provide for combustion of only the self-combustible components in the dust containing gases. Accordingly, the exhaust gas, which contains unreacted gases and tar mists, is fed into the dust collector disposed on the ground. It has been proposed to employ a system having no combustion chamber, wherein the dust containing gases are sucked from the coal feed car through a fixed duct to a dust collector disposed on the ground. In the latter system, a large amount of combustible gases and tar mists are directly fed into the dust collector. Heretofore, a mechanical wet type dust collector has been employed as the dust collector at the coal discharge step because it contains such combustible gases and tar mists. It has been difficult to employ an electrical dust collector cause of the expense and because of th danger, as combustible gases are involved. However, the efficiency of dust collection of dusts having less than 1$\mu$ of diameter and tar mists is quite low in the wet type dust collectors, and the dusts and tar mists are passed through the dust collector to be discharged into the atmosphere as floating dusts whereby pollution of the environment is caused over a broad area.

SUMMARY OF THE INVENTION

Accordingly, it is an object of the present invention to provide a dust collection system for a coke oven which attains a satisfactory dust collecting effect and offers high efficiency as a common dust collector for both the coke discharge step and the coal charge step from the viewpoint that both steps are usually operated at different times and are rarely operated at the same time.

The foregoing and other objects of the present invention are attained by providing a dust collecting system for a coke oven which comprises employing a bag filter dust collector as a common dust collector at both the coke discharge step and the coal charge step and firstly conducting the dust collection at the coke discharge step and then alternatively repeating the dust collecting operations at the coal charge step and the coke discharge step, whereby an adhesion of tar mists on the bag filter surface is prevented.

BRIEF DESCRIPTION OF THE DRAWINGS

Other objects, features and attendant advantages of the present invention will be more fully appreciated as the same becomes better understood from the following detailed description when considered in connection with the accompanying drawings, in which like reference characters designate like or corresponding parts throughout the several views, and wherein:

FIG. 1 is a schematic sectional front view of a coke oven and a dust collector;

FIG. 3 (*b*) is a partial enlarged sectional view showing the deposition of dust on the filter;

FIG. 3 (*c*) is a partial enlarged sectional view showing the condition of the filter after shaking down the dust;

FIG. 4 is a diagram for illustrating the operation of a coke oven; and

FIG. 5 is a block diagram of a dust collecting system for a coke oven according to the present invention.

DETAILED DESCRIPTION OF THE PREFERRED EMBODIMENTS

Figure 2:
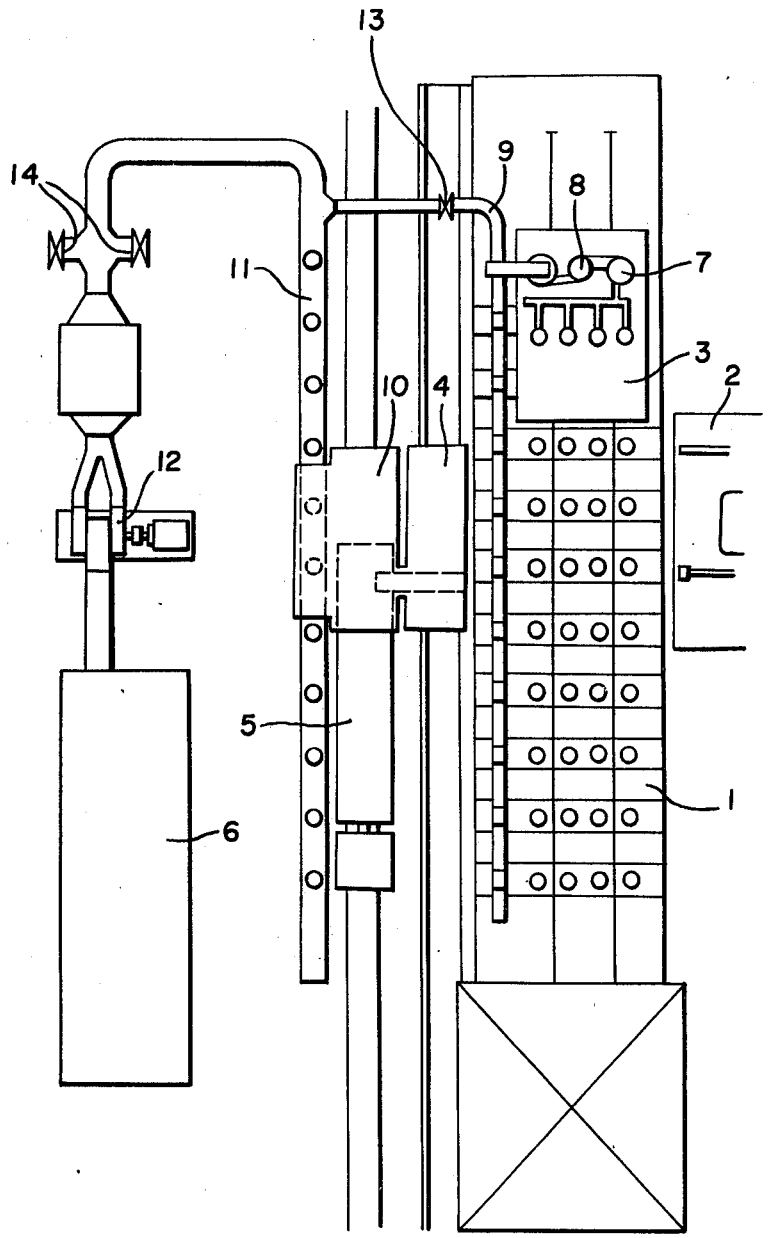
FIG. 2 is a schematic plan view of the embodiment of FIG. 1.

In general, it is considered to be difficult to employ a bag filter system for the collection of dust containing gas which contains adhesive and tacky particles, such as tar mists. In the practicle test of a coke oven, when only gas spouted out at the coal charge step is collected by a bag filter, the closing of the filter results in the system being inoperative for several days.

In accordance with the system of the present invention, one dust collector is commonly used for the operation at both the coke discharge step and the coal charge step, with the dust collection for the coke discharge step being conducted first, and then the dust collections at both steps are alternatingly conducted to prevent direct deposition of tar mists on the surface of the filter in the bag filter dust collector. Stable operation can thus be continued without closing the filter and the discharge of fine dusts and tar mists is prevented so as to prevent pollution of the environment.

In the operation of a coke oven, the coke discharge step and the coal charge step are generally alternatingly conducted. Accordingly, when the dust occurring in the coke discharge step is sucked into the bag filter dust collector, the dust is deposited on the surface of the filter without tackiness and the dusts collected are easily shaken down because most of the dust in the coke discharge operation are fine coke particles. When the dust containing gas, which contains tar mists, at the coal charge step is drawn or sucked in, the tar mists are collected by depositing on the deposited fine coke particles, because the surface of the filter is covered with the fine coke particles deposited at the coke discharge step. Accordingly, the tar mists do not adhere on the surface of the filter and can be easily shaken down from the filter with the deposited fine coke particles. That is, the dusts containing tar mists formed at the coal feed operation are deposited between fine coke particle layers formed at the coke discharge step in sandwich-like fashion because the coke discharge step and the coal charge step are alternatingly conducted. Accordingly, the tar mists are not directly deposited on the surface of the filter and closure of the filter does not occur.

Another embodiment of the invention is to provide a dust collecting system wherein the dust collection at the coke discharge step for a coke guide car and the dust collection at the coal charge step are conducted by the control of a common blower, so as to employ only one dust collector. As is wellknown, many oven chambers are formed in a coke oven. The coke oven operation has been conducted by feeding coal to each of the oven chambers and discharging the resulting coke after a carbonization for more than ten hours. Coal is fed into an empty oven chamber after the coke discharging step, and the operations in many oven chambers arranged in parallel are sequentially conducted to provide a continuous operation.

It generally takes about 7.5 minutes for the overall operation in one oven chamber, including the coke discharge step, the coal charge step and other steps. As shown in FIG. 4, this includes about 90 seconds for the coke discharge step, about 210 seconds for the coal charge step and about 150 seconds for the other steps. A large amount of dust is spouted out in both the coke discharge step and the coal charge step. Accordingly, it is necessary to conduct a dust collection in both of these steps.

In the past, a dust collecting system having a duct on the ground connected with the coke oven and a dust collector connected to the duct has been employed, and on the other hand, a hood for collecting the dust containing gas spouted out at the coke discharge step is equipped on a guide car so as to feed it to the duct, in order to collect dusts spouted out at the coke discharge step. On the other hand, it has been proposed to provide a dust collecting system which has a duct on the ground similar to the former dust collecting system, for example, a scrubber, in the case where dust is caused by the charging coal. In such conventional systems, each separate dust collecting duct and each dust collector are employed for each step, and each blower is continuously driven at a constant rotating rate.

As is clear from FIG. 4, each blower is driven at each constant rotating rate, though the coke discharge step and the coal charge step are simultaneously conducted. Accordingly, the operation cost, especially the electric power cost, is expensive. Each damper, each blower and each dust collector are equipped in the side of the charging car and also in the side of the coke guide car. Accordingly, the cost for the apparatus is quite expensive, thus providing an economic disadvantage.

The purpose of the present invention is to overcome such disadvantages, and to provide a dust collecting system in a coke oven which comprises a dust collecting duct for a guide car and a dust collecting duct for a coal feed car, or the charging car, being connected through a common blower to one dust collector. The rotating speed of the blower is controlled so as to operate depending upon the flow rates of the dust containing gases at the coke discharge step and the coal charge step, whereby the cost of the apparatus and the operation cost are highly reduced. Since the coke discharge step and the coal charge step are conducted in series, it is unnecessary to equip two dust collectors on the side of the charging car side and the side of the guide car.

The flow rate of the dust containing gas sucked in the dust collecting operation in a coke oven will be described in detail before the details of the preferred embodiment are given. In the coke oven operation the coke discharge step and the coal charge step are conducted in series, as stated above. Accordingly if it is possible to control the flow rates of the dust containing gases, one dust collector can be commonly employed depending upon each of the operations. When the flow rate of the dust containing gas passed through the coke guide car at the coke discharge step is given as Q, a flow rate of the dust containing gas passing through the charging car is usually enough to suck the gas at a flow rate of Q/2 or less (hereinafter, it is considered to be Q/2), and more than the surging limit (for example, Q/4). In order to control the flow rates of the dust containing gases, it is possible to employ a coke damper control system. However, in the illustrated embodiment, the flow rates of the dust containing gases are controlled by changing the rotating speed of a blower and controlling a damper for preventing surging.

In Table 1, which follows, the electric powers required and the conditions of the coke oven operation in the damper control system and the rotating speed control system of the preferred embodiment will be shown.

TABLE 1

| | 0 sec. | 30 sec. | 120 sec. | 330 sec. | 450 sec. |
|---|---|---|---|---|---|
| | ←30 sec→ | ←90 sec→ | ←210 sec→ | ←120 sec→ | |
| Coke oven operation | other step | coke discharge step | coal charge step | other step | |
| Rate of gas sucked ($Nm^3$/min) | Q/2 | Q | Q/2 | Q/2 | |
| Damper control system | | | | | |
| rotating speed of blower | | N | con-stant | | |

TABLE 1-continued

| | 0 sec. | 30 sec. | 120 sec. | 330 sec. | 450 sec. |
|---|---|---|---|---|---|
| | ←30 sec→ | ←90 sec→ | ←210 sec→ | ←120 sec→ | |
| Coke oven operation | other step | coke discharge step | coal charge step | other step | |
| (r.p.m.) power of blower (KW) | about $\frac{2}{3}$P | P | rotation about $\frac{2}{3}$P | about $\frac{2}{3}$P | |
| Rotating speed control system rotating speed of blower (r.p.m.) | N/2 | N | N/2 | N/2 | |
| power of blower (KW) | P/8 | P | P/8 | P/8 | |

The data of Table 1 are given by the following equations and facts. When the rotating speed of the blower is changed, the following relations are given:

$$Q' = Q \cdot N'/N \quad (1)$$

$$P_{T'} = P_T(N'/N)^2 \quad (2)$$

$$P' = P \cdot (N'/N)^3 \quad (3)$$

wherein: Q = the rated flow rate;
Q' = the flow rate at a rotating speed of N';
$P_T$ = the rated gas pressure;
$P_{T'}$ = the gas pressure at a rotating speed of N';
P = the rated electric power;
P' = the electric power at a rotating speed of N'; and
N = the rated rotating speed.

The electric power at the flow rate of Q/2 in the damper control system is about $\frac{2}{3}$ P because of the inherent characteristics of a blower.

Referring now to the drawings, and more particularly to FIGS. 1 and 2, there is shown a coke oven 1 equipped with a pusher 2, a coal feed or charging car 3, a coke guide car 4, a fire extinguishing or quenching car 5, and a bag filter dust collector 6. A combustion chamber 7 and a suction blower 8 with a pre-dust collector are disposed on the charging car 3, which is provided with a duct 9. A hood 10 is provided on the coke guide car 4 for which a duct 11 is provided. The pre-dust collector associated with suction blower 8 is formed by a wet type dust collector and the like and the pre-dust fed from the combustion chamber 7 is collected therein such that the temperature of the gas is decreased. The ducts 9 and 11 are connected, as one body, through a blower 12 to the dust collector 6, which is disposed on the ground adjacent to the coke oven, and the connections are provided with dampers 13 and 14, respectively, for preventing surging.

In the operation of a coke oven, gases and dusts spout out when the coke falls down through the coke guide car 4 and into the quenching car 5 in the coke discharge step. When the hood 10 of the guide car is connected to the duct 11, the gases and dusts are collected in the hood 10 equipped on the coke guide car 4 by the operation of the blower 12 disposed on the ground, and they are sucked into the duct 11 for the coke guide car 4 and the dust containing gas is thus cleaned by the dust collector 6 so as to be discharged safely into the atmosphere.

In the following coal charging step, the dust containing gas spouted out is sucked up by the operation of the suction blower 8 equipped on the charging car 3 and the combustible components in the gas are burned in the combustion chamber 7. The combustion chamber 7 is arranged in a limited space on the coal charging car 3, whereby the capacity of the combustion chamber is not enough to accomplish combustion of the combustible components. Accordingly, the exhaust gas contains a relatively large amount of tar mists, coal dusts and coke dusts. When the delivery of the pre-dust collector of the suction blower 8 of the charging car 3 is connected to the duct 9, the dust containing gas, after the combustion of the combustible components, is fed into the duct 9 for the charging car, and the gas is sucked into the blower 12 in the same manner as that of the coke discharging step, and the dust containing gas is thus cleaned by the dust collector 6 so as to be discharged therefrom into the atmosphere.

The suction rate at the coal charge step is usually about $\frac{1}{2}$ or less than the suction rate at the coke discharge step. The suction rate should be controlled at the coal charge step. Accordingly, the suction rate is controlled by preventing surging of the blower 12 by opening the damper 14 or by controlling the rotating speed of the blower 12.

Figure 3:
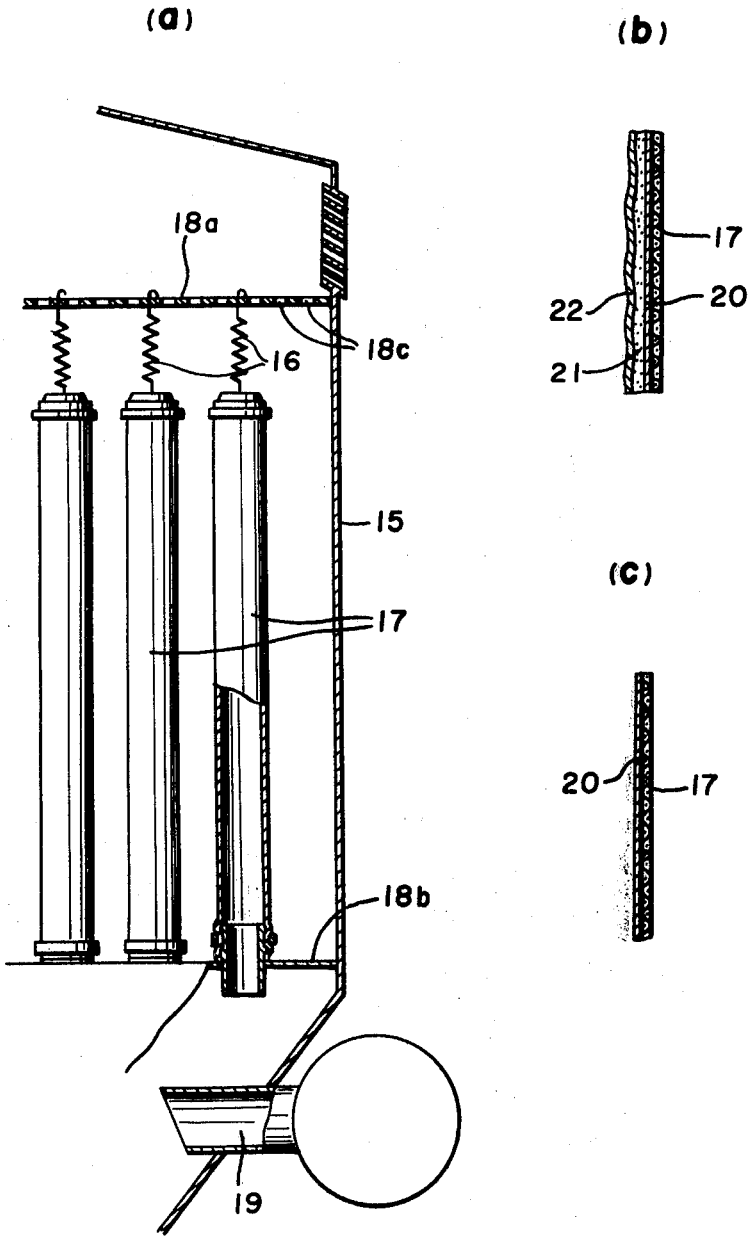
FIG. 3 (*a*) is a partial sectional front view of an inner part of a bag filter dust collector according to this invention.

In the bag filter dust collector 6, a plurality of tubular filters 17 are suspended by springs 16 within a casing 15, as shown in FIG. 3 (*a*). The exhaust gas is passed from the inner part of the tubular filter 17 into the casing 15 and is passed therefrom through a partition 18*a*, through a plurality of holes 18*c* in the partition, in an upper direction so as to be discharged into the atmosphere. A combined inlet duct 19 for the dust containing gases opens into casing 15 below a lower partition 18*b* therein, to pass such gases into the tubular filters 17, which open into the part of casing 15 below the partition 18*b*. In the condition of the dust collector 6 shown in FIG. 3 (*c*), a preliminary dust layer 20 deposited thereon is always kept on the inner surface of the tubular filter 17 and it is not easily shaken off. As shown in FIG. 3 (*b*), the dust 21 at the coke discharge step is collected on the surface of the preliminarily deposited layer 20. The dusts and tar mists 22 at the following coal charge step are collected on the surface of the dusts 21 collected in the former step.

When a compressed air is fed from the upper part of the upper partition 18*a* so as to inject the compressed gas from the outer surface of the tubular filter 17 to the center part thereof, so as to shake off the deposited dusts, the dusts 21 collected at the step of discharging the product and the dusts and tar mists 22 collected at the coal charge step are shaken down from the inner surface of the tubular filter 17, as shown in FIG. 3 (*c*). Accordingly, the tubular filters themselves are not affected by the dusts containing tar mists.

In an ideal operation, the suction rate in the dust collection at the coal charge step is reduced to about one-half by controlling the speed of the blower 12 and the speed for filtering the gas in the bag filter dust collector 6 is reduced, whereby the increase of pressure loss on the filter is reduced and the shaking-down rate is reduced and the life of the tubular filters is thus prolonged.

As stated above, in accordance with the system of the present invention, one dust collector can be commonly employed for both the coke discharge step and the coal charging step. Moreover, a bag filter dust collector, which has a high efficiency of dust collection, can be employed for collecting dusts containing tar mists, and the dust containing gas can thus be highly cleaned by employing the dust collector. Accordingly, the problem of air pollution is not caused by discharging the exhaust gas after the dust collection into the atmosphere.

The dust collector of the present invention is not limited, however, to a common dust collector for the coke guide car and the charging car. It is further possible, for example, to employ a combination of a dust collector in the pusher and the aforementioned dust collector for the charging car, or even a combination of all three such dust collectors.

Referring now to FIG. 5, the embodiment of the present invention will be described in further detail. Here, the reference numeral 31 designates a charging car. A dust collecting duct 32 for the charging car 31, being connected thereto through a dust collecting connector 42, is connected to a dust collecting duct 34 for coke discharge at both ends so as to form a loop. The ends of the dust collecting ducts 32 and 34 are connected through a suction duct 36 to a blower 35. The dust collecting duct 34 is connected through a dust collecting connector 41 to a coke guide car 33.

The blower 35 is connected in series to a dust collector 37 and a stack 38. An automatic damper 39 is disposed on the suction side of the blower 35 for preventing the blower from surging during the time that neither the dust collection for the charging car, nor the dust collection for the coke discharge step, is being conducted. The blower 35 is driven by a motor 40 whose rotating speed is controllable to drive the blower 35 so as to draw at a flow rate of Q/2 of air. In FIG. 5, the flow rate of the dust containing gas sucked from the coke guide car 33 is given as Q, the flow rate of the dust containing gas sucked from the charging car 31 is given as Q/2, and the flow rate of air sucked from the automatic damper 39 is given as Q/2. The efficiency of the blower 35 is to draw a flow rate of gas equal to Q.

The conditions of the operation of the coke oven dust collecting system in the one step of the coke oven operation are as follows with the described embodiment. In the normal condition that neither the dust collection for the coke discharge step nor the dust collection for the coal charging step is being conducted, the dust collecting connectors 41 and 42 for the guide car 33 and the charging car 31 are not respectively connected to the dust collecting ducts 34 and 32 under opening of the automatic damper 39. Accordingly, the flow rate of gas sucked or drawn by the blower 35 from the dust collecting ducts 32 and 34 is zero. Air is drawn only from the automatic damper 39. The rotating speed of the blower 35 is N/2 and the electric power is P/8.

When the dust collecting connector 41 of the coke guide car 33 is connected to the dust collecting duct 34 for the coke discharge step, the automatic damper 39 is switched from the open state to the closed state by the signal for coke discharge given from a pusher, not shown, and the rotating speed of the blower is raised from N/2 to N. At this time, the flow rate of the dust containing gas drawn by the blower from the coke guide car 33 is Q. The electric power is P.

As shown in FIG. 4, when the coke discharge is finished, after about 90 seconds, the dust collecting connector 41 of the coke guide car 33 is separated from the dust collecting duct 34 to permit operation of dust collection for the coal charge step to be conducted. In the dust collection for the coal charge step, the dust collecting connector 42 of the charging car 31 is connected to the dust collecting duct 32 for the coal charge step. The rotating speed of the blower 35 is reduced from N to N/2 by the signal for the coal charging step given from the charging car 31. At this time, the automatic damper 39 is kept in its closed state. The dust containing gas is drawn by the blower 35 from the charging gas 31 at a flow rate of Q/2. The electric power is P/8. In the coal charging step, as shown in FIG. 4, the coal charging operation takes 210 seconds.

When the coal charging operation is finished, the dust collecting connector 42 of the charging car 31 is separated from the dust collecting duct 32 to stop the charging of coal. The signal of the charging car 31 is turned off to switch the automatic damper 39 from the closed state to the open state. Thus, the first dust collecting step in the first coke oven is completed and the dust collecting step in the next coke oven is conducted. The operation is sequentially repeated.

In a damper control system for controlling the flow rate of gas with a fixed damper disposed in a dust collecting duct 32 for the coal charging step, without changing the rotating speed of the blower 35, even though the flow rate of gas is reduced to Q/2, the electric power reduces to only about $\frac{2}{3}$ P, because of blower characteristics. However, in the blower rotating speed control system, the electric power reduces to $\frac{1}{8}$ P in such case. Moreover, it takes only 90 seconds to suck the gas at the maximum flow rate of Q in the coke discharge step during 450 seconds of total operation time for the coke discharge step and the coal charging step in one coke oven. Accordingly, it takes 360 seconds to suck the gas at the flow rate of Q/2 in the coal charging step and other steps, whereby the effect of reduced power consumption is remarkable.

In this embodiment, there is no disclosure of the speed control system for driving the blower 35. Thus, it is considered from the viewpoint of severe operation in which many switchings between acceleration and reduction are given in the dust collector of the coke oven, that it is preferable to employ a static control apparatus which can set a desirable rotating speed corresponding to a flow rate of gas sucked and which has a regenerative breaking system at the reduction of the speed, whereby the effect of power reduction is improved and other operational effects can be attained. With regard to types of dust collectors, it is preferable to employ a dust collector in which a flow rate of the dust containing gas is low under satisfactory characteristics of the rotating speed control in order to employ an electrical dust collector or a bag filter which has high efficiency of dust collection. From the viewpoint of pressure loss, it can be applicable under pressure reduction in the rotating speed reduction of the blower. It is also possible of course to employ another type dust collector which has similar characteristics.

In this embodiment, one dust collector is commonly employed for dust collection at the coke discharge step and for dust collection at the coal charging step for carbonization, and the rotating speed of the blower is controlled. Thus, it is possible to expect the same effect of the rotating speed control in the blower of the specific dust collector for discharging coke from a coke oven. As stated above, in accordance with the system of this invention, the dust collecting duct for coal charging and the dust collecting duct for coke discharge are connected through one common blower to one dust collector and the rotating speed of the blower is controlled so as to operate it to provide desirable flow rates of gases in both the coke discharge step and the coal charging step.

Accordingly, both the dust collection for the coke discharge step and the dust collection for the coal charging step can be attained by employing a single dust collector. Thus, the apparatus can be simplified and the cost for the apparatus can be highly reduced. Also, the rotating speed of the blower is controlled, depending upon the dust collection for the coke discharge step and the dust collection for the coal charging step, whereby the cost of operation can be highly reduced to give further economical advantages Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the U.S. is:

1. A method of dust collecting from a coke oven system in which coal is charged and coke discharged comprising the steps of:

a. first collecting gases and dust spouted off from a coke discharging operation;

b. next collecting gases and dust spouted off from a coal charging operation;

c. successively alternating steps (a) and (b);

d. using suctioning means to suction said collected gases and dust to a common bag filter dust collector; and e. maintaining the flow rate of said suctioned out gases and dust collected in the coal charging operation at one-half or less than the flow rate of said suctioned out gases and dust collected in the coke discharging operation and more than the minimum flow rate necessary to prevent surging;

whereby fine coal particles emitted during the coal charging operation are deposited on a layer of the fine coke particles emitted during the coke discharging operation and the adhesion of tar mists on the surface of the filter in the bag filter dust collector is prevented.

2. The method of Step 1 including the following steps before step (d):

burning the gases and dust spouted off in the coal charging operation; and filtering the burned gases and dust.

* * * * *